US008308514B1

(12) United States Patent
Su et al.

(10) Patent No.: US 8,308,514 B1
(45) Date of Patent: Nov. 13, 2012

(54) SIM CARD HOLDER

(75) Inventors: Yu-Hung Su, New Taipei (TW); Yao-Ting Wang, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 13/212,156

(22) Filed: Aug. 17, 2011

(51) Int. Cl.
*H01R 24/00* (2006.01)

(52) U.S. Cl. ..... 439/630

(58) Field of Classification Search ..... 439/630–632, 439/495, 490, 492–493
See application file for complete search history.

(56) References Cited

U.S. PATENT DOCUMENTS 7,338,326 B2 * 3/2008 Su ..... 439/638
8,123,558 B2 * 2/2012 Su et al. ..... 439/607.01
8,147,262 B1 * 4/2012 Su et al. ..... 439/159
8,147,276 B2 * 4/2012 Wang et al. ..... 439/660
2009/0036000 A1 * 2/2009 Cheng et al. ..... 439/752.5
2010/0233911 A1 * 9/2010 Su et al. ..... 439/629

* cited by examiner

*Primary Examiner* — Neil Abrams
*Assistant Examiner* — Phuongchi Nguyen
(74) *Attorney, Agent, or Firm* — Cheng-Ju Chiang

(57) ABSTRACT

A subscriber identity model (SIM) card holder for fixing and connecting a SIM card with a circuit board is disclosed. The SIM card holder comprises a tray, a terminal rack, and electrically conductive terminals. A bottom surface of the tray defines a first card slot. A bottom surface of the first card slot defines a second card slot. The second slot penetrates the first card slot as well as a top surface of the tray. When the SIM card is contained in the first card slot and/or a micro-SIM card is contained in the second card slot, metal contacting parts of the SIM card are positioned directly under metal contacting parts of the micro-SIM card. The SIM card holder of the present invention is capable of containing the SIM card and the micro-SIM card.

4 Claims, 4 Drawing Sheets

SIM CARD HOLDER

BACKGROUND OF THE INVENTION

1. Field of the Invention

The present invention generally relates to a mobile phone assembly field, and more particularly to a subscriber identity model (SIM, also referred as a subscriber identity module) card holder for containing a SIM card and a micro-SIM card.

2. Description of Prior Art

With the development of information technology, mobile phones serve as a type of instant messaging communication tool in modern life. A SIM card is required when using a mobile phone. That is, the SIM card is a subscriber identity card of a user for implementing a function of information transmission with a communication system. Therefore, a SIM card holder is required to contain a SIM card in the mobile phone, such that the SIM card holder with the SIM card can electrically connect with the mobile phone to implement the function of communication.

Nowadays, a type of micro-SIM card is developed on the market. However, there is not a type of SIM card holder to contain the SIM card and the micro-SIM card at the same time. Therefore, it is difficult for the user to use the mobile phone having the SIM card and the micro-SIM card.

Accordingly, a type of SIM card holder which is capable of containing the SIM card as well as the micro-SIM card is required.

SUMMARY OF THE INVENTION

To solve the above-mentioned difficulties in the prior art, an objective of the present invention is to provide a SIM card holder capable of containing a SIM card and a micro-SIM card.

To implement the above-mentioned object, the SIM card holder for fixing and connecting a SIM card with a circuit board according to an aspect of the present invention comprises a tray, a terminal rack, and electrically conductive terminals. A bottom surface of the terminal rack is fixedly connected with the circuit board, and terminal slots are defined on the bottom surface of the terminal rack. The terminals slots penetrate the top surface as well as the bottom surface of the terminal rack. The bottom surface of the tray defines a first card slot. A bottom surface of the first card slot defines a second card slot. The second slot penetrates the first card slot as well as the top surface of the tray. When the SIM card is contained in the first card slot and/or a micro-SIM card is contained in the second card slot, metal contacting parts of the SIM card are positioned directly under metal contacting parts of the micro-SIM card. One end of each of the electrically conducting terminals is welded with the circuit board, and the other end of each of the electrically conducting terminals protrudes from one corresponding terminal slot and enters into the first card slot as well as the second card slot for contacting with the metal contacting parts of the SIM card and/or the micro-SIM card.

In one preferred embodiment, the SIM card holder further comprises a first pressing piece. The first pressing piece comprises a first pressing part and two first bending parts which are bent downwardly from two sides of the first pressing part. The first pressing part and the first bending parts form a first pressing slot. The first pressing slot presses the tray, and the pressing part sticks to the second slot. The two first bending parts respectively stick to the front surface and the rear surface of the tray. When the micro-SIM card is contained in the second card slot, the first pressing piece presses the tray and the first pressing part contacts with the micro-SIM card, so that the micro-SIM card is retained in the second slot and well contacts the electrically conducting terminals.

In another preferred embodiment, the two first bending parts respectively define positioning holes. Positioning posts are disposed on the front surface and the rear surface of the tray. The positioning post protrudes into the positioning holes. The positioning holes and the positioning posts match each other, so that the first pressing piece can well press the tray without being shifted due to the elastic force between the electrically conducting terminals and the micro-SIM card.

In yet another embodiment, the SIM card holder further comprises a second pressing piece. There are indentations disposed at corners of the bottom surface of the terminal rack. The second pressing piece comprises a second pressing part and two second bending parts which are bent downwardly from two sides of the second pressing part. The second pressing part and the second bending parts form a second pressing slot. The second pressing slot presses the tray, the terminal rack, and the first pressing piece. The second bending parts respectively comprise a plate protruding in a horizontal direction. The plates protrude into the indentations. Elastic sheets are disposed on the second pressing part. One end of each of the elastic sheets is connected with the second pressing part, and the other end of each of the elastic sheets is bent to form a bending part which tilts upward. Each bending part is capable of contacting the top surface of the tray. Concave slots are formed on the top surface of the tray for corresponding to the bending parts. The bending parts are capable of protruding into the concave slots for contacting the top surface of the tray. The plates and the indentations match each other, and the bending parts and the concave slots match each other, so that the tray, the terminal rack, and the first pressing piece, can be pressed together for ensuring that the SIM card and/or the micro-SIM card can be electrically connected well with the electrically conducting terminals.

Compared with the prior arts, the tray defines the first card slot and the second card slot according to the SIM card holder of the present invention. That is, the bottom surface of the first card slot defines the second card slot penetrating through the first card slot and the top surface of the tray, wherein the shape of the second card slot corresponds to the micro-SIM card. Accordingly, when the SIM card is contained in the first card slot and/or the micro-SIM card is contained in the second card slot, the electrically conducting terminals can contact and electrically connect the metal contacting parts of the SIM card and/or the micro-SIM card. As a result, the SIM card holder of the present invention can contain the SIM card and the micro-SIM card.

DETAILED DESCRIPTION OF THE INVENTION

Figure 1:
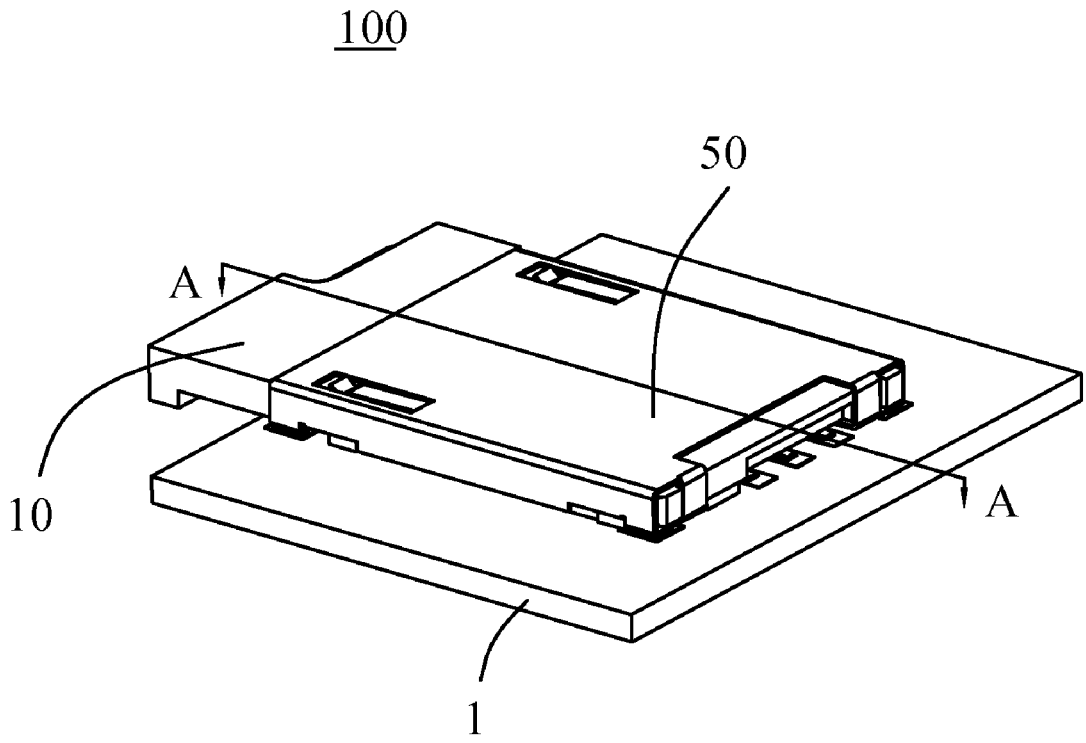
FIG. 1 is a perspective view of a SIM card holder in accordance with an embodiment of the present invention.

The present invention will be described in detail in conjunction with the appending drawings. Please refer to FIGS.

1-5, a SIM card holder 100 used for fixing and connecting a SIM card with a circuit board 1 according to the present invention comprises a tray 10, a terminal rack 20, and electrically conductive terminals 30. The tray 10 comprises a top surface 10*a*, a bottom surface 10*b*, a front surface 10*c* and a rear surface 10*d*. The terminal rack 20 comprises a top surface 20*a* and a bottom surface 20*b*.

Figure 2:
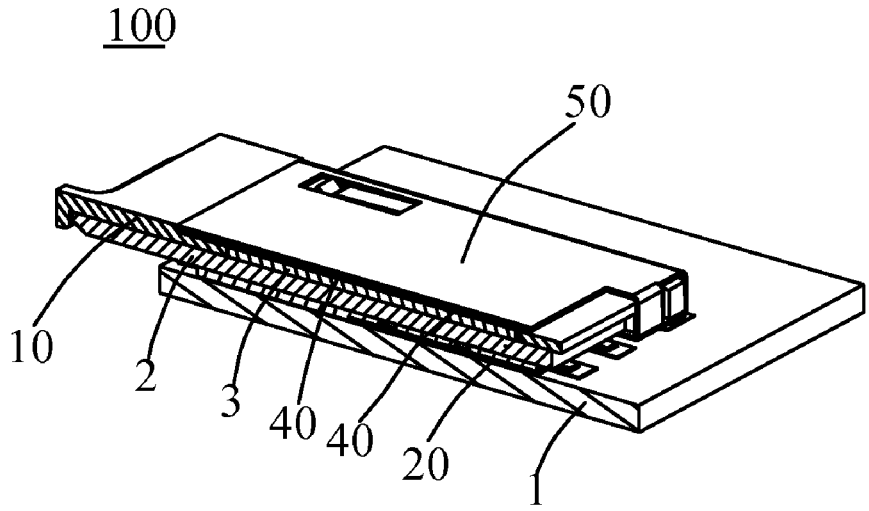
FIG. 2 is a cross-section view of the SIM card holder in FIG. 1 along a direction A-A in accordance with the present invention.
Figure 3:
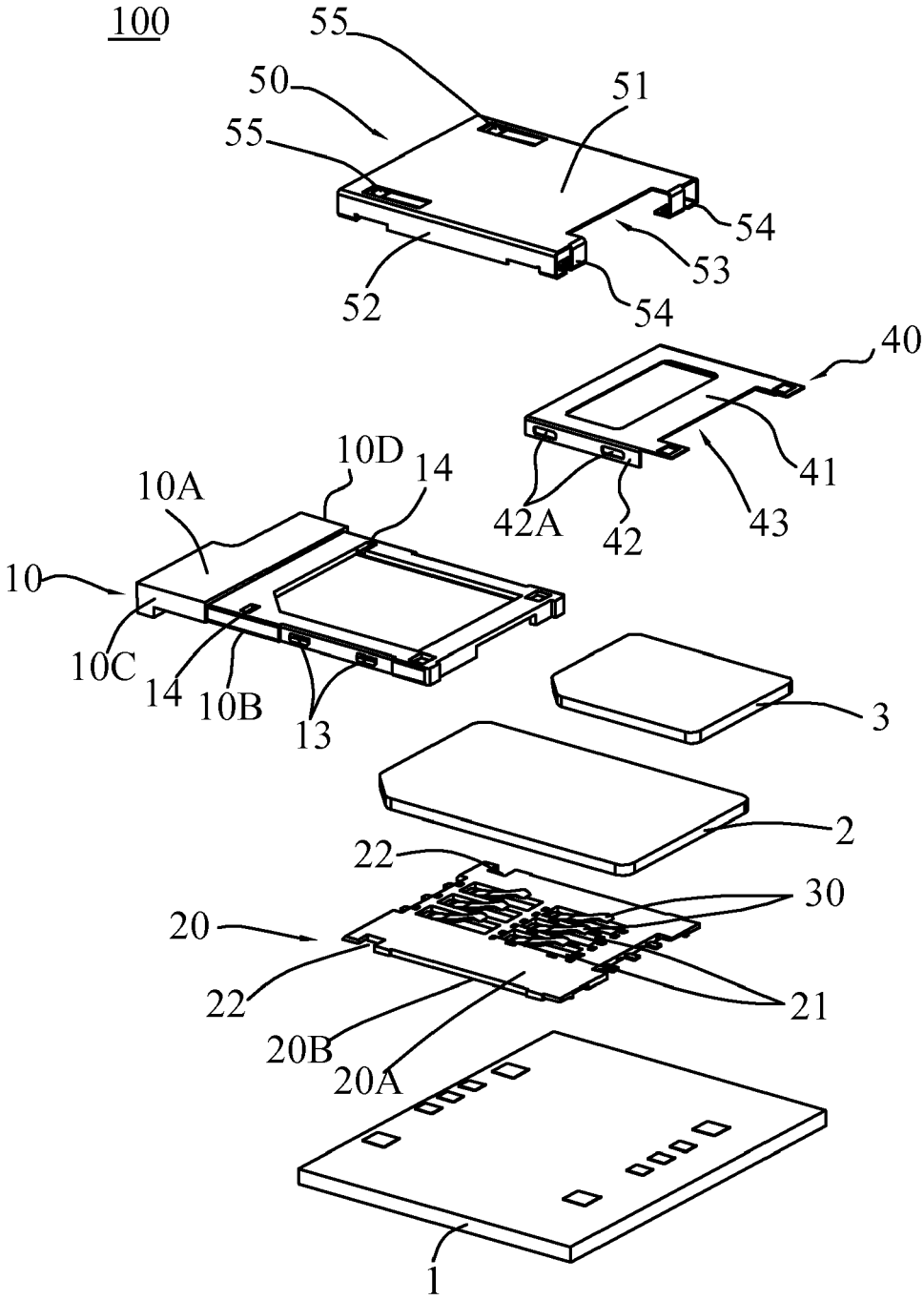
FIG. 3 is a decomposition view of the SIM card holder in FIG. 1 in accordance with the present invention.
Figure 4:
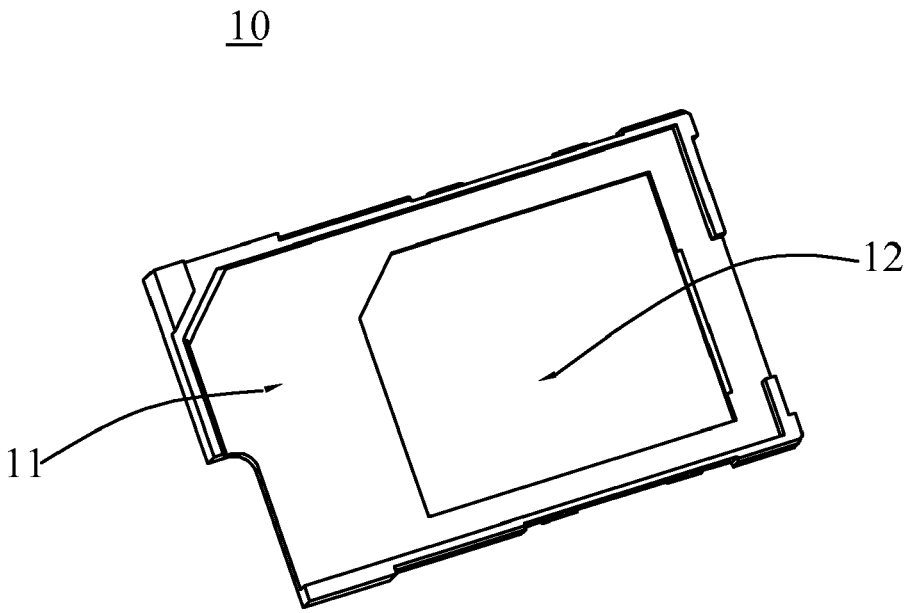
FIG. 4 is a schematic diagram showing a tray of the SIM card holder in FIG. 1 in accordance with the present invention.

Referring to FIGS. 2-4, the bottom surface 20*b* of the terminal rack 20 is fixedly connected with the circuit board 1, and terminal slots 21 are defined on the bottom surface 20*b* of the terminal rack 20. The terminals slots 21 penetrate the top surface 20*a* and the bottom surface 20*b* of the terminal rack 20. The bottom surface 10*b* of the tray 10 defines a first card slot 11 which matches the shape of a SIM card 2. The bottom surface of the first card slot 11 defines a second card slot 12 which matches the shape of the micro-SIM card 3. The second slot 12 penetrates the first card slot 11 as well as the top surface 10*a* of the tray 10. When the SIM card 2 is contained in the first card slot 11 and/or the micro-SIM card 3 is contained in the second card slot 12, metal contacting parts of the SIM card 2 are positioned directly under metal contacting parts of the micro-SIM card 3. One end of each of the electrically conducting terminals 30 is welded with the circuit board 1, and the other end of each of the electrically conducting terminals 30 protrudes from one corresponding terminal slot 21 and enters into the first card slot 11 and the second card slot 12 for contacting with the metal contacting parts of the SIM card 2 and/or the micro-SIM card.

Referring to FIG. 3, the SIM card holder 100 further comprises a first pressing piece 40. The first pressing piece 40 comprises a first pressing part 41 and two first bending parts 42 which are bent downwardly from two sides of the first pressing part 41. The first pressing part 41 and the first bending parts 42 form a first pressing slot 43. The first pressing slot 43 presses the tray 10, and the pressing part 41 sticks to the second slot 12. The two first bending parts 42 respectively stick to the front surface 10*c* and the rear surface 10*d* of the tray 10. When the micro-SIM card 3 is contained in the second card slot 12, the first pressing piece 40 presses the tray 10 and the first pressing part 41 contacts with the micro-SIM card 3, so that the micro-SIM card 3 is retained in the second slot 12 and contacts well with the electrically conducting terminals 30.

Referring to FIG. 3, the two first bending parts 42 respectively define positioning holes 42*a*. Positioning posts 13 are disposed on the front surface 10*c* and the rear surface 10*d* of the tray 10. The positioning post 13 protrudes into the positioning holes 42*a*. The positioning holes 42*a* and the positioning posts 13 match each other, so that the first pressing piece 40 can well press the tray 10 without being shifted due to the elastic force between the electrically conducting terminals 30 and the micro-SIM card 3.

Figure 5:
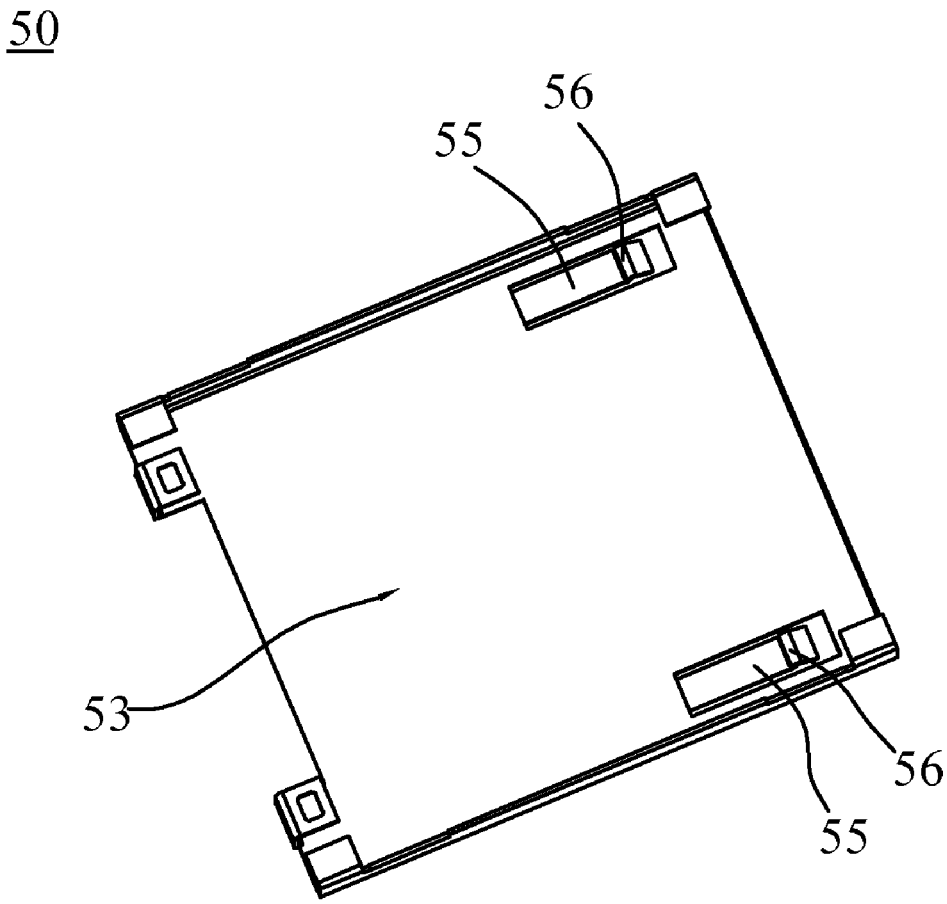
FIG. 5 is a schematic diagram showing a first pressing piece of the SIM card holder in FIG. 1 in accordance with the present invention

Referring to FIGS. 3-5, the SIM card holder 100 further comprises a second pressing piece 50. There are indentations 22 disposed at corners of the bottom surface 20*b* of the terminal rack 20. The second pressing piece 50 comprises a second pressing part 51 and two second bending parts 52 which are bent downwardly from two sides of the second pressing part 51. The second pressing part 51 and the second bending parts 52 form a second pressing slot 53. The second pressing slot 53 presses the tray 10, the terminal rack 20, and the first pressing piece 40. The second bending parts 52 respectively comprise a plate 54 protruding in a horizontal direction. The plates 54 protrude into the indentations 22. Elastic sheets 55 are disposed on the second pressing part 51. One end of each of the elastic sheets is connected with the second pressing part 52, and the other end of each of the elastic sheets is bent to form a bending part 56 which tilts upward. Each bending part 56 is capable of contacting the top surface 10*a* of the tray 10. Concave slots 14 are formed on the top surface 10*a* of the tray 10 for corresponding to the bending parts 56. The bending parts 56 are capable of protruding into the concave slots 14 for contacting the top surface 10*a* of the tray 10. The plates 54 and the indentations 22 match each other, and the bending parts 56 and the concave slots 54 match each other, so that the tray 10, the terminal rack 20, and the first pressing piece 40, can be pressed together for ensuring that the SIM card and/or the micro-SIM card can be electrically connected well with the electrically conducting terminals 30.

Referring to FIGS. 1-5, the tray 10 defines the first card slot 11 and the second card slot 12 according to the SIM card holder of the present invention. That is, the bottom surface of the first card slot 11 defines the second card slot 12 penetrating through the first card slot 11 as well as the top surface 10*a* of the tray 10, wherein the shape of the second card slot 12 corresponds to the micro-SIM card. Accordingly, either the SIM card 2 is contained in the first card slot 11 and/or the micro-SIM card is contained in the second card slot 12, the electrically conducting terminals 30 can contact and electrically connect the metal contacting parts of the SIM card 2 and/or the micro-SIM card 3. As a result, the SIM card holder 100 of the present invention can contain the SIM card 2 and the micro-SIM card 3.

As is understood by a person skilled in the art, the foregoing preferred embodiments of the present invention are illustrative rather than limiting of the present invention. It is intended that they cover various modifications and similar arrangements be included within the spirit and scope of the appended claims, the scope of which should be accorded the broadest interpretation so as to encompass all such modifications and similar structure.

What is claimed is:

1. A subscriber identity model (SIM) card holder for fixing and connecting a SIM card with a circuit board, the SIM card holder comprising a tray, a terminal rack, and electrically conductive terminals, a bottom surface of the terminal rack being fixedly connected with the circuit board, terminal slots penetrating a top surface and the bottom surface of the terminal rack, a bottom surface of the tray defining a first card slot, a bottom surface of the first card slot defining a second card slot, the SIM card being contained in the first card slot, a micro-SIM card being contained in the second card slot, metal contacting parts of the SIM card being positioned directly under metal contacting parts of the micro-SIM card, one end of each of the electrically conducting terminals being welded with the circuit board, and the other end of each of the electrically conducting terminals protruding from one corresponding terminal slot and entering into the first card slot as well as the second card slot for contacting with the metal contacting parts of the SIM card and/or the micro-SIM card;

wherein the SIM card holder further comprises a first pressing piece having a first pressing part and two first bending parts, the two first bending parts respectively define positioning holes, and positioning posts which are disposed on a front surface and a rear surface of the tray protrude into the positioning holes.

2. The SIM card holder as claimed in claim 1, further comprising a second pressing piece, indentations being disposed at corners of the bottom surface of the terminal rack, wherein the second pressing piece comprises a second pressing part and two second bending parts which are bent downwardly from two sides of the second pressing part, the second pressing part and the second bending parts form a second pressing slot, the second pressing slot presses the tray, the terminal rack and the first pressing piece, the second bending parts respectively comprise a plate protruding in a horizontal direction, and the plates protrude into the indentations.

3. The SIM card holder as claimed in claim 2, wherein elastic sheets are disposed on the second pressing part, one end of each of the elastic sheets is connected with the second pressing part, the other end of each of the elastic sheets is bent to form a bending part which tilts upward, and each bending part is capable of contacting a top surface of the tray.

4. The SIM card holder as claimed in claim 1, wherein the two first bending parts are bent downwardly from two sides of the first pressing part, the first pressing part and the first bending parts form a first pressing slot, the first pressing slot presses the tray, the first pressing part sticks to the second card slot, and the two first bending parts respectively stick to the front surface as well as the rear surface of the tray.

* * * * *